United States Patent [19]

Cieciuch et al.

[11] 4,060,417

[45] * Nov. 29, 1977

[54] DIFFUSION TRANSFER ELEMENTS COMPRISING COLOR-PROVIDING COMPOUNDS CAPABLE OF CLEAVAGE UPON REACTION WITH SILVER IONS AND SILVER ION BARRIER LAYERS

[75] Inventors: Ronald F. W. Cieciuch; Roberta R. Luhowy, both of Newton; Frank A. Meneghini, Arlington; Howard G. Rogers, Weston, all of Mass.

[73] Assignee: Polaroid Corporation, Cambridge, Mass.

[ * ] Notice: The portion of the term of this patent subsequent to Mar. 6, 1990, has been disclaimed.

[21] Appl. No.: 574,296

[22] Filed: May 5, 1975

Related U.S. Application Data

[60] Continuation-in-part of Ser. No. 465,694, April 30, 1974, abandoned, which is a continuation-in-part of Ser. No. 317,168, Dec. 21, 1972, abandoned, which is a division of Ser. No. 155,123, June 17, 1971, Pat. No. 3,719,489.

[51] Int. Cl.[2] ..... G03C 7/00; G03C 1/40; G03C 1/76; G03C 5/54

[52] U.S. Cl. ..... 96/3; 96/29 D; 96/72; 96/73; 96/74; 96/77

[58] Field of Search ..... 96/3, 29 D, 77, 72–74

[56] References Cited

U.S. PATENT DOCUMENTS

| | | | |
|---|---|---|---|
| 2,665,986 | 1/1954 | Rott | 96/3 |
| 2,673,800 | 3/1954 | Meeussen et al. | 96/3 |
| 3,443,941 | 5/1969 | Rogers | 96/3 |
| 3,585,028 | 6/1971 | Stephans | 96/3 |
| 3,635,707 | 1/1972 | Cole | 96/3 |
| 3,647,436 | 3/1972 | Bush | 96/3 |
| 3,689,272 | 9/1972 | Schwan et al. | 96/3 |
| 3,719,488 | 3/1973 | Locatell et al. | 96/3 |
| 3,719,489 | 9/1974 | Cieciuch et al. | 96/3 |
| 3,837,854 | 9/1974 | Waxman et al. | 96/3 |

*Primary Examiner*—David Klein
*Assistant Examiner*—Richard L. Schilling
*Attorney, Agent, or Firm*—Sybil A. Campbell

[57] ABSTRACT

A silver ion scavenger layer is employed between adjacent silver halide strata to enhance color separation in multicolor photographic images prepared by processes which utilize the imagewise distribution of silver ions and/or soluble silver complex made available during development to liberate a corresponding imagewise distribution of dye or dye intermediate from a color-providing compound.

52 Claims, 1 Drawing Figure

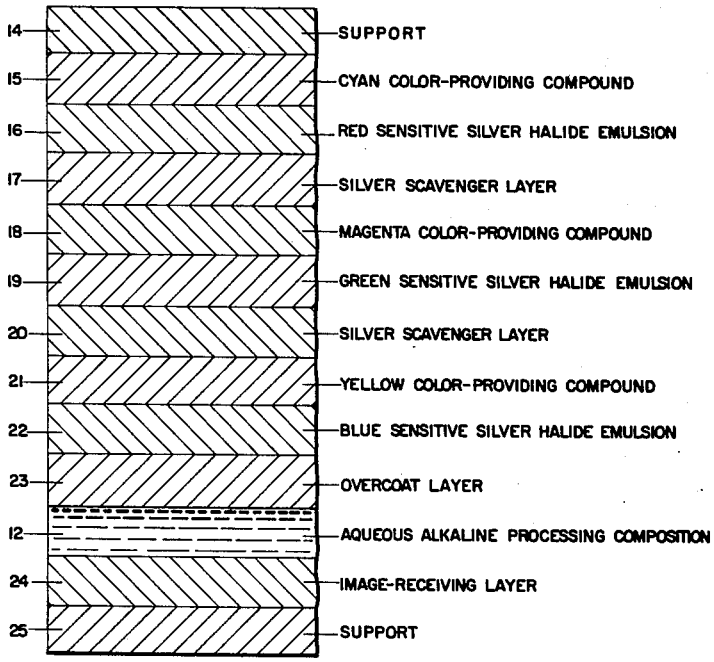

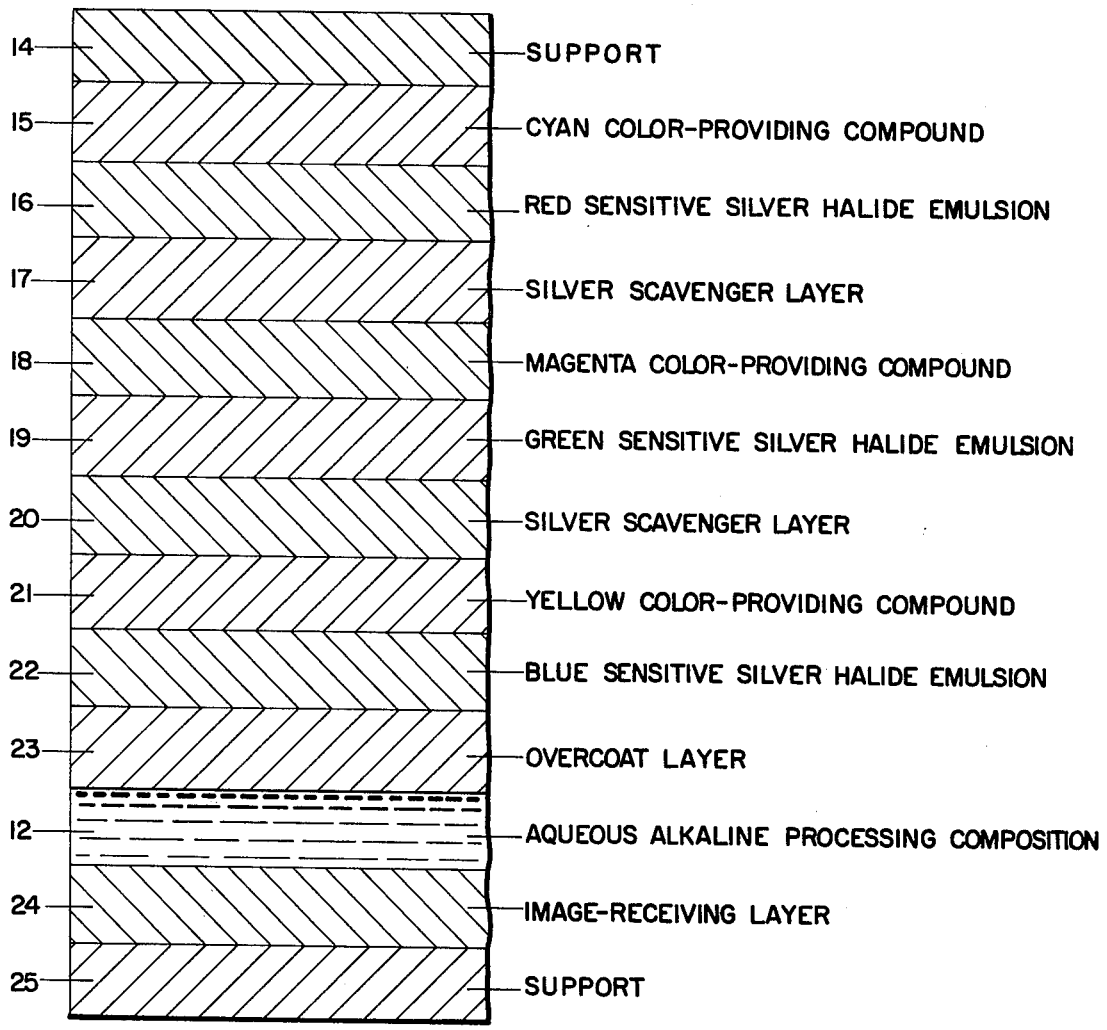
14
SUPPORT
15
CYAN COLOR-PROVIDING COMPOUND
16
RED SENSITIVE SILVER HALIDE EMULSION
17
SILVER SCAVENGER LAYER
18
MAGENTA COLOR-PROVIDING COMPOUND
19
GREEN SENSITIVE SILVER HALIDE EMULSION
20
SILVER SCAVENGER LAYER
21
YELLOW COLOR-PROVIDING COMPOUND
22
BLUE SENSITIVE SILVER HALIDE EMULSION
23
OVERCOAT LAYER
12
AQUEOUS ALKALINE PROCESSING COMPOSITION
24
IMAGE-RECEIVING LAYER
25
SUPPORT

DIFFUSION TRANSFER ELEMENTS COMPRISING COLOR-PROVIDING COMPOUNDS CAPABLE OF CLEAVAGE UPON REACTION WITH SILVER IONS AND SILVER ION BARRIER LAYERS

BACKGROUND OF THE INVENTION

CROSS REFERENCE TO RELATED PATENT APPLICATIONS

This application is a continuation-in-part of our copending U.S. Application Ser. No. 465,694 filed Apr. 30, 1974, now abandoned, which is a continuation-in-part of our U.S. application Ser. No. 317,168 filed Dec. 21, 1972, now abandoned, which in turn is a division of our U.S. application Ser. No. 155,123 filed June 17, 1971 and now U.S. Pat. No. 3,719,489 issued Mar. 6, 1973.

1. FIELD OF THE INVENTION

This invention relates to photography, and more particularly, to photographic products and processes for preparing color images utilizing as the dye image-forming material, a color-providing compound capable of undergoing cleavage in the presence of an imagewise distribution of silver ion and/or soluble silver complex to liberate a corresponding imagewise distribution of color-providing moiety, e.g., a dye.

2. DESCRIPTION OF THE PRIOR ART

Diffusion transfer photographic processes are now well-known. In preparing silver images according to such processes, an exposed photosensitive element comprising a light-sensitive silver halide emulsion is developed by treating the emulsion with a processing composition comprising an aqueous alkaline solution of a silver halide developing agent and a silver halide solvent. The developable silver halide of the emulsion is reduced to image silver by the developing agent while the silver halide solvent forms an imagewise distribution of a soluble complex with the undeveloped silver halide. This imagewise distribution of soluble silver complex is, at least in part, transferred by imbibition to a superposed image-receiving layer where it is reduced to form a silver transfer image.

Aforementioned U.S. Pat. No. 3,719,489 describes and claims photographic processes employing certain photographically inert compounds which are stable in the photographic processing composition but capable of undergoing cleavage in the presence of the imagewise distribution of silver ions made available during processing of a silver halide emulsion to liberate a reagent, such as, a photographically active reagent or a dye in an imagewise distribution corresponding to that of said silver ions. Depending upon the photographic process and the result it is desired to achieve the inert parent compound may be diffusible or substantially non-diffusible in the processing solution and the reagent liberated also may be diffusible or substantially non-diffusible in the processing composition.

In one embodiment disclosed in the aforementioned patent, color images are produced by using as the photographically inert compounds, color-providing compounds which are substantially non-diffusible in the photographic processing solution but capable of undergoing cleavage in the presence of the imagewise distribution of silver ions and/or soluble silver complex made available in the undeveloped and partially developed areas of a silver halide emulsion as a function of development to liberate a more mobile and diffusible color-providing moiety in an imagewise distribution corresponding to the imagewise distribution of said ions and/or said complex. The subsequent formation of a color image is the result of the differential in diffusibility between the parent compound and liberated color-providing moiety whereby the imagewise distribution of the more diffusible color-providing moiety released in undeveloped and partially developed areas is free to transfer.

Both monochromatic and multicolor images may be produced in this manner. For example, the above-described color-providing compounds may be employed in photographic systems utilizing integral multilayer photosensitive elements comprising at least two selectively sensitized silver halide emulsion strata with associated color-providing material which are processed simultaneously and without separation to provide a multicolor image on a single common image-receiving element.

Among the compounds disclosed as useful in liberating a reagent in the presence of silver ion are sulfur-nitrogen compounds containing the group,

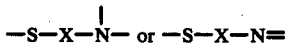

wherein X is

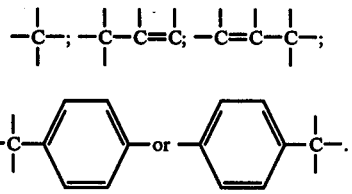

These compounds may be linear or cyclic in structure, and when cyclic, either or both the S and N atoms may be constituents of the ring. Particularly useful are cyclic compounds containing the group

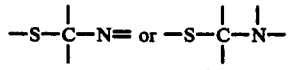

as part of the ring and preferably, the latter. Like 1,3-sulfur-nitrogen compounds, in general, these compounds undergo cleavage in a stepwise fashion between the S atom and the C atom common to the S and N atoms and also between the N atom and the common C atom.

As discussed in the aforementioned patent, sulfur-nitrogen compounds, as exemplified by thiazolidine compounds, exhibit good stability in alkaline media, such as the aqueous alkaline processing compositions employed in conventional "tray" and diffusion transfer photographic processes, and undergo cleavage in the presence of silver ions and/or soluble silver complex made available during processing to release a reagent as a smaller molecule in an imagewise distribution corresponding to the imagewise distribution of silver ions and/or soluble silver complex. For example, thiazolidine compounds release a diffusible dye such that a diffusion transfer image is obtained in reasonable processing times.

The present invention is concerned with photographic processes of this type and with photographic products useful therein for producing multicolor images of improved quality.

SUMMARY OF THE INVENTION

It is the primary object of the present invention to provide photographic products and processes of the foregoing description for producing multicolor images exhibiting improved color separation and whiter highlights.

Another object of this invention is to provide photographic products comprising a photosensitive element particularly an integral multilayer photosensitive element having at least one layer of scavenger for silver ion and/or soluble silver complex.

Other objects of the invention will in part be obvious and will in part appear hereinafter.

The invention accordingly comprises the several steps and the relation and order of one or more such steps with respect to each of the others, and the product possessing the features, properties and the relation of elements, which are exemplified in the following detailed disclosure, and the scope of the application which will be indicated in the claims.

For a fuller understanding of the nature and object of the invention, reference should be had to the following detailed description taken in connection with the accompanying drawing.

BRIEF DESCRIPTION OF THE DRAWINGS

The FIGURE is an enlarged, diagrammatic, fragmentary sectional view of one product contemplated by this invention during processing thereof.

DESCRIPTION OF THE PREFERRED EMBODIMENTS

As mentioned previously, the present invention is concerned with the preparation of color photographic images by utilizing the imagewise distribution of silver ions and/or soluble silver complex made available during development of a photosensitive element to liberate a corresponding imagewise distribution of a dye or dye intermediate from a color-providing compound. It has now been found that improved color separation may be achieved in the production of multicolor images by including in the photosensitive element, one or more layers containing a scavenger for silver ion and/or soluble silver complex to confine diffusion of the imagewise distribution of silver ions and/or soluble silver complex made available during development to the appropriate layer of color-providing compound. In addition to the improvement in color separation, the inclusion of such a layer or layers in an integral multilayer photosensitive element provides multicolor images having improved highlights.

In the present invention, any material may be used as the silver scavenger layer that is capable of capturing silver ion and/or soluble silver complex provided, of course, that the layer is permeable to the processing reagents, e.g., the silver halide developing agent and silver halide solvent and allows color-providing moiety to diffuse through to form a multicolor diffusion transfer image. Useful materials include silver complexing agents and compounds that generate silver complexing agents which form stable, preferably non-diffusible complexes with silver ion and keep the silver ion in the same oxidation state and silver precipitating agents that reduce silver ion to metallic silver. Examples of specific materials that may be employed for forming stable, non-diffusible complexes with silver ion and/or soluble silver complex are polymers containing recurring mercapto-substituted tetrazole moieties such as those forming the subject matter of copending U.S. patent application Ser. No. 520,983 of Michael J. Grasshoff and Jerome L. Reid filed Nov. 5, 1974, now U.S. Pat. No. 3,936,401 issued Feb. 2, 1976, and polymers containing recurring mercapto-ethylamine moieties such as those forming the subject matter of copending U.S. patent application Ser. No. 574,295 of Louis Locatell, Jr. filed concurrently herewith and now U.S. Pat. No. 4,021,416 issued May 3, 1977. Silver precipitating agents useful in this invention may be readily selected from among the many materials taught in the art to be useful as nucleating agents in silver transfer processes. Examples of particularly suitable silver precipitating agents are the metallic sulfides and selenides and colloidal metals disclosed in U.S. Pat. No. 2,698,237. Other useful materials are compounds which react with silver ion to form a complex that decomposes to provide a nucleating agent, and/or a silver complexing agent. Illustrative of such compounds are polymers containing recurring thiourea moieties such as those described by C. G. Overberger et al., Journal of Polymer Science: Part A, Vol. 3, pp. 3625–3634 (1965). The reaction of thiourea and its derivatives with silver salts and the decomposition reaction of the resulting thiourea-silver salt complex with the deposition of silver sulfide has been described by B. Javor, Kemija i Industrija (Zagreb) 14, (g), pp. 739–742 (1965). As will be readily apparent suitable precautions should be taken to insure that the silver ion scavenger be confined to its own layer for cases in which the particular scavenger selected might adversely affect the sensitometry.

In forming color images according to one embodiment of the present invention, a relatively non-diffusible color-providing compound is present, for example, in a layer associated with each of at least two selectively sensitized silver halide emulsion layers and a silver scavenger layer is provided between the two emulsion layers. The emulsion layers, after being exposed, are processed simultaneously and without separation by the application of an aqueous alkaline processing solution including a silver halide developing agent and a silver halide solvent. The imagewise distribution of silver ions such as contained in the soluble silver complex made available during processing of each emulsion layer migrates to the color-providing material associated with the emulsion and the color-providing material undergoes cleavage in the presence of the complex to provide an imagewise distribution of a more diffusible color-providing moiety. By virtue of the silver scavenger layer positioned between the two emulsion layers, the migration of the imagewise distribution of soluble silver complex formed during processing of each emulsion layer is confined to the color-providing material associated with each emulsion and prevented from diffusing into the color-providing material associated with the other emulsion layer or layers. The subsequent formation of a color image is the result of a differential in diffusibility between the parent material and liberated color-providing moiety whereby the imagewise distribution of the more diffusible color-providing moiety released in undeveloped and partially developed areas is free to transfer. For example, where the non-diffusible parent material is colored, e.g., comprises a complete dye, the imagewise distribution of diffusible dye released therefrom may be simply washed away to leave an image associated with the emulsion, or it may be transferred by imbibition to an image-receiving layer, e.g., a dyeable stratum of the character heretofore known in the art to provide a color transfer image thereon.

The respective mobility characteristics of the parent compound and of the liberated color-providing moiety may be substantially the same, or they may be different as appropriate for a given photographic process. A differential in diffusibility between the parent compound and the moiety liberated therefrom may be achieved in various ways, for example, by using a normally immobile and non-diffusible parent compound which upon cleavage releases a diffusible color-providing moiety, or conversely, by using a normally mobile parent compound which upon cleavage releases a color-providing moiety that is substantially non-diffusible.

To be useful in the present invention, the parent compound should be photographically inert and stable in the processing solution, i.e., should remain intact in the processing composition in the absence of silver ion at least during the processing interval, but should be capable of undergoing cleavage in the presence of the imagewise distribution of silver ions and/or the imagewise distribution of soluble silver complex containing silver ions made available as a function of development to release a color-providing moiety, such as, a dye. Its rate of cleavage in the presence of silver ion, however, should be such that an imagewise distribution of color-providing moiety is obtained that corresponds to the imagewise distribution of silver ions or soluble silver complex formed in the partially exposed and unexposed areas of the emulsion. If the rate of cleavage is excessive, color-providing moiety may be released to some extent in the exposed areas.

Illustrated below are examples of compounds which may be used to release a color-providing moiety and the silver accelerated cleavage reactions which they undergo.

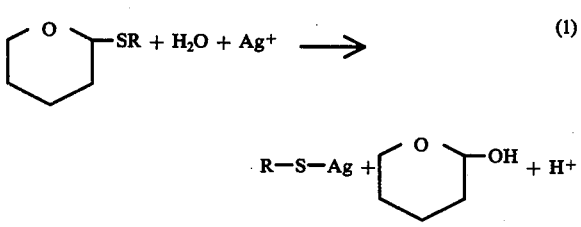

(1)

$$R{-}S{-}S{-}R + H_2O + Ag^+ \longrightarrow R{-}S{-}Ag + H^+ + [R{-}SOH] \quad (2)$$

$$R{-}\overset{H}{N}{-}\overset{SR'}{C}{=}Z + Et_3N + Ag^+ \longrightarrow R'{-}SAg + RN{=}C{=}Z + Et_3N^+H \quad (3)$$

(Z is NR', O or S)

$$H_2O + \underset{RS}{CH_2}\underset{NHR'}{CHCOOR''} + Ag^+ \longrightarrow \underset{AgS}{CH_2}\underset{NHR'}{CHCOOR''} + ROH + H^+ \quad (4)$$

-continued $$H_2O + R\overset{O}{\overset{\|}{C}}SR' + Ag^+ \longrightarrow R'SAg + R\overset{O}{\overset{\|}{C}}OH + H^+ \quad (5)$$

$$(CH_3)_3{-}SiC{\equiv}CR + H_2O + Ag^+ \longrightarrow Ag{-}C{\equiv}CR + H^+ + [(CH_3)_3{-}SiOH] \quad (6)$$

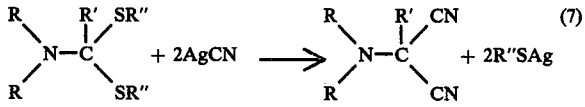

(7)

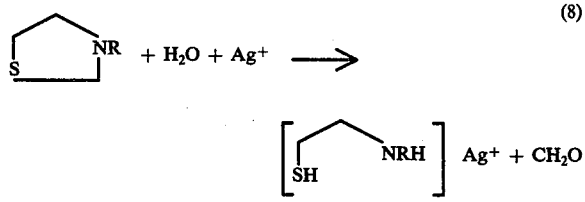

(8)

For use in the present invention, the above compounds may be appropriately substituted with the desired color-providing moiety it is desired to liberate and with other group (s) as may be necessary to achieve a differential in diffusibility between the uncleaved parent compound and the moiety released therefrom. Where such a differential in diffusibility is necessary or desired for the particular photographic process, the parent color-providing compound may be substituted with an immobilizing group or "anchor", that renders the compound substantially non-diffusible in the processing solution, or, rather than a single immobilizing group, the parent color-providing compound may be substituted with two or more groups which together preclude migration of the compound from its position in the photographic element. When several groups together are used to immobilize the compound, one or more of the groups may be on the fragment to be released as a diffusible reagent so long as the group(s) does not reduce to any appreciable extent the mobility and diffusibility of the fragment subsequent to cleavage.

It will be appreciated that where a single immobilizing group is used to anchor the color-providing compound, its position on the compound should be such that upon cleavage, it will be on a fragment different from the fragment to be released as the diffusible color-providing moiety. Depending upon the photographic process used and upon the location of the parent compound in the photographic element, it may be preferable to position the immobilizing group on that portion of the parent compound that ultimately forms a complex with the silver ion. For example, when producing positive transfer images using diffusion transfer techniques, it is preferred to anchor the fragment that will complex the silver ion in the photosensitive element to avoid possible staining of the color image formed in the image-receiving sheet.

The selection of a particular immobilizing group(s) for anchoring the parent compound will depend primarily on whether it is desired to employ only one immobilizing group or to employ two or more groups which together are capable of anchoring the compound. Where two or more groups are employed to immobilize the compound, lower alkyl groups, butyl or hexyl, for example, may be used to achieve the requisite differential in diffusibility between the parent color-providing compound and the color-providing moiety released therefrom. Where only one group is used to immobilize the compound, it is more effective to employ, for example, a higher alkyl radical such as octyl, decyl, dodecyl, stearyl, and oleyl or a carbocyclic or heterocyclic ring having six members or more. Where cyclic compounds are employed, the carbocyclic or heterocyclic immobilizing group may be bonded to a single atom or to adjacent atoms of the parent molecule and may be bonded to a single atom by a valence or ionic bond or through a spiro union.

As the "color-providing moiety" in forming color images according to the present invention, there may be used a complete dye or a dye intermediate capable of yielding a complete dye upon subsequent reaction, for example, upon reaction with a suitable coupler to form a complete dye. The coupling reaction may take place directly in the image-receiving layer, or it may take place in the emulsion layer or in the layer of processing composition after which the complete dye formed diffuses to the image-receiving layer.

Complete dyes which may be used as the color-providing moiety may comprise any of the general classes of dyes heretofore known in the art, for example, nitro, indophenol, indoaniline, anthraquinone, azomethine, anthrapyridone, azo, thiazole, di- and triphenyl methane, cyanine, phthalocyanine and metal-complexed azo, azomethine and phthalocyanine dyes. Dye intermediates include any molecule which when released is capable of forming a dye upon reaction with another molecule. For example, an imagewise distribution of a dye intermediate may be released from a 1,3-sulfur-nitrogen compound, e.g., a thiazolidine, which imagewise distribution of dye intermediate in turn reacts with another molecule to produce a corresponding imagewise distribution of complete dye. Photographic processes and products utilizing dye-forming systems wherein an imagewise distribution of a complete dye is produced by the reaction of an aldehyde or ketone dye intermediate and a color-forming reagent, such as, a methylene coupler comprises the subject matter of U.S. Pat. No. 3,719,488 of Louis Locatell, Jr., Frank A. Meneghini and Howard G. Rogers.

The color-providing moiety, whether a complete dye or dye former, may be linked directly to an atom of the parent molecule by a valence or ionic bond or through a spiro union, or it may be linked indirectly to the parent molecule through an appropriate linking group either acyclic or cyclic. Typical linking groups include cycloalkyl, such as cyclohexyl; —CONH —; —alkylene—CONH—; arylene—CONH—; alkylene; and arylene wherein alkylene may be ethylene, propylene, butylene and arylene may be phenylene. The term color-providing moiety as used herein includes any linking group and the moiety may contain on the color-providing and/or linking portion various solubilizing substituents, e.g., sulfo, hydroxyl or carboxyl groups to adjust its solubility characteristics.

In addition to the above, useful dyes include those which are colorless or of a color other than that ultimately desired in a certain environment, such as at a particular pH level, but upon a change in environment, e.g., from acid to alkaline conditions, take on a color change. Color-providing materials of this nature include indicator dyes or leuco dyes. It is also contemplated that dyes may be employed which undergo a color shift or change in spectral absorption characteristics during or after processing. Such dyes may be referred to as "temporarily shifted" dyes. The temporary shift may, for example, be effected by acylation, the acyl group being removable by hydrolysis in the alkaline processing composition. It is also within the scope of the present invention to employ metal complexed or complexable dyes and to employ dyes, the non-complexed forms of which are substantially colorless, but which, when complexed during or subsequent to image formation, are of the desired color.

Though some of the compounds enumerated above may cleave in the absence of silver ion under extreme conditions, such as strong heating, they are sufficiently stable under neutral, acid and alkaline conditions at ambient temperatures to remain intact under the processing conditions encountered in conventional and diffusion transfer photography until silver ion becomes available as a function of development. However, the reactivities of the various compounds toward silver ion may vary and thus, some compounds may cleave more rapidly in the presence of silver ion than others. Accordingly, it will be appreciated that the particular compound selected should have the cleavage rate necessary for obtaining an imagewise distribution of color-providing moiety under the particular processing conditions employed. In diffusion transfer processes, it is desirable that the parent compound cleave in the presence of silver ion and/or soluble silver complex containing silver ion to release a diffusible color-providing moiety such that a transfer image is obtained within a reasonable processing time.

Of the aforementioned classes of compounds, the 1,3-sulfur-nitrogen compounds have been found especially satisfactory. As discussed above, these compounds may be linear, or they may be cyclic in structure with either or both of the S and N atoms being constituents of the ring which should contain at least four atoms. The compounds may be saturated or unsaturated provided the S and N atoms each are bonded to the common, i.e., intermediate, carbon atom by a single bond.

Among the 1,3-sulfur-nitrogen compounds that may be used in the present invention are those represented in the following formulae:

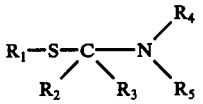

(I)

wherein $R_1$ and $R_5$ each are a monovalent organic radical and $R_2$, $R_3$ and $R_4$ each are hydrogen or a monovalent organic radical;

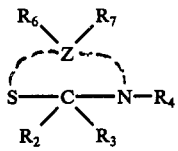

(II)

wherein $R_2$, $R_3$ and $R_4$ have the same meaning as in formula (I) above; $R_6$ and $R_7$ on the same or different atoms each are hydrogen or a monovalent organic radical and taken together represent a substituted or unsubstituted carbocyclic or heterocyclic ring; Z represents the atoms, preferably carbon atoms, necessary to complete a ring system having up to 20 members;

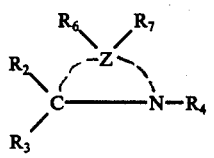

(III)

wherein $R_2$, $R_3$, $R_4$, $R_6$, $R_7$ and Z have the same meaning as in formula (II) above; and

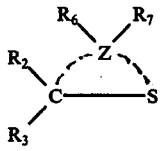

(IV)

wherein $R_2$, $R_3$, $R_6$, $R_7$ and Z have the same meaning as in formula (II) above.

Examples of cyclic compounds which may be used in the present invention are thiazolidines, tetrahydro-1,3-thiazines, benzothiazolines, benzimidazolines, tetrahydrothiophenes, s-thithianes, 1,3-dithianes, tetrahydrothiopyrans, 1,3-dithiolanes, pyrrolidines, imidazolidines, hexahydro-s-triazines, piperazines, piperidines, and morpholines. Where the ring contains a nitrogen atom but no sulfur atom or where the ring contains a sulfur atom but no nitrogen atom, the compound will be appropriately substituted with a sulfur or nitrogen-containing group to obtain the 1,3-sulfur-nitrogen configuration. For example, in Formula (IV) above, the sulfur-nitrogen configuration may be obtained by selecting as the $R_2$ or $R_3$ group, a monovalent organic radical

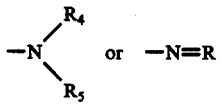

wherein $R_4$ and $R_5$ have the same meaning given above and R is a divalent organic radical. Likewise, the desired configuration may be obtained with compounds of formula (III) by selecting as $R_4$, a monovalent organic radical

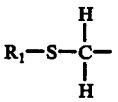

or by selecting as the $R_2$ or $R_3$ group, a monovalent organic radical — S — $R_1$ wherein $R_1$ has the same meaning given above. It will be appreciated that the compound may contain more than one sulfur-nitrogen configuration if desired. As an illustration, the compound of formula (II) may be substituted with a cyclic 1,3-sulfur-nitrogen substituent in the 2-position through a linking group, such as a methylene group, to give, e.g., a bis compound.

It will be understood that at least one of the substituents of the compounds illustrated in the above formulae will be the color-providing moiety it is desired to release from the parent compound, which moiety may be released as an amine, aldehyde, ketone, etc., depending upon the position of the substituent on the parent. Also, one or more of the R substituents may be selected to immobilize the compound in processes where it is desired to render the uncleaved parent compound substantially non-diffusible in the processing solution, or one or more of the R substituents may be selected to enhance the solubility of the compound in processes where it is desired to render the parent compound diffusible in the processing solution. Suitable immobilizing and solubilizing groups have been enumerated above. The positioning of these groups on the parent color-providing compound will depend upon the diffusionibility characteristics desired for the parent compound and for the color-providing moiety released upon cleavage in a given process. As noted previously, the parent and the moiety liberated therefrom may exhibit the same diffusibility characteristics in the photographic processing solution. For example, in one embodiment of the process of aforementioned U.S. Pat. No. 3,719,488, both the parent and dye intermediate released therefrom may be non-diffusible so that the complete dye formed upon reaction with the color-forming reagent remains in the photosensitive element to provide a color image therein. The diffusibility characteristics also may be different. For example, the parent compound may be non-diffusible and comprise a complete dye which dye is released as a more diffusible fragment that is transferred to a dye image-receiving element to provide a color transfer image thereon. In addition to the immobilizing and/or solubilizing groups, it will be appreciated that R groups may comprise other substituents which do not interfere with its intended use.

Typical of the substitutents that may be used in the above formulae include carboxy, sulfo, nitro, hydroxy, halo, e.g., chloro and bromo, cyano and hydrocarbon radicals including aliphatic, cycloaliphatic, aromatic and heterocyclic radicals. The radicals may possess ethylenic or acetylenic unsaturation, and the carbon chains may be interrupted by heteroatoms or heteroatom groups, such as, S, O, N, SO, NH and so forth. Also, the radicals may contain substituents, e.g., phenyl, alkyl, alkyl ether, aryl ether, carbalkoxy, carboxy, hydroxy, sulfo, halo, cyano, nitro, and alkylamino.

Examples of suitable radicals are substituted and unsubstituted alkyl groups, such as, methyl, ethyl, otcyl, dodecyl; substituted and unsubstituted cycloalkyl radicals, such as, cyclohexyl, cyclopentyl, cyclooctyl; substituted and unsubstituted alkenyl groups, such as, vinyl, allyl, butenyl, decenyl, octadienyl, hexatrienyl; substituted and unsubstituted cycloalkenyl groups, such as, cyclopentenyl, cycloheptenyl, cyclohexadienyl; substituted and unsubstituted alkynyl groups, such as, ethynyl, hexynyl, octynyl; substituted and unsubstituted aryl radicals, such as, phenyl, tolyl, benzyl and naphthyl; and substituted and unsubstituted heterocyclic groups, such as those having a 4-, 5- or 6 -membered ring and containing O, N, S, and combinations thereof derived from, e.g., pyrrole, pyrazole, oxazole, thiazole, imidazole, pyrimidine, piperidine, piperazine, thiophene, pyrrolidine, azetidine. Where a single hydrocarbon moiety is used as the immobilizing group, higher acyl radicals such as oleoyl and stearoyl groups have been found useful.

It will be appreciated by those skilled in the art that the vinyl and phenylene analogs of the above sulfur-nitrogen compounds, including those exemplified in formulae (I) – (IV), are useful in the present invention. The 1,3-sulfur-nitrogen compounds and their vinyl and phenylene analogs may be defined as containing the group,

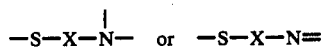

wherein X is

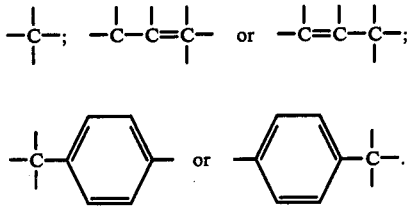

As in the compounds illustrated in formulae (I) - (IV), the above analogs may be substituted with an immobilizing group and/or a solubilizing group and with a color-providing moiety.

Compounds found especially suitable for forming images by diffusion transfer are certain cyclic sulfur-nitrogen compounds where both the S and N atoms are included in the ring, particularly thiazolidines and benzothiazolines. These compounds exhibit the desired stability in the processing composition, and in the presence of silver ions undergo cleavage at the desired rate to release a reagent, e.g., a color-providing moiety in an imagewise distribution corresponding to that of the silver ions and/or soluble silver complex containing the same made available in the undeveloped areas of the emulsion. Besides exhibiting these characteristics under the highly alkaline conditions ordinarily employed in diffusion transfer processes, they may be employed under neutral and acid conditions as well.

Illustrative of the aforementioned cyclic compounds particularly useful in forming dye images are those represented in the following formulae (V) and (VI), and preferably (VI).

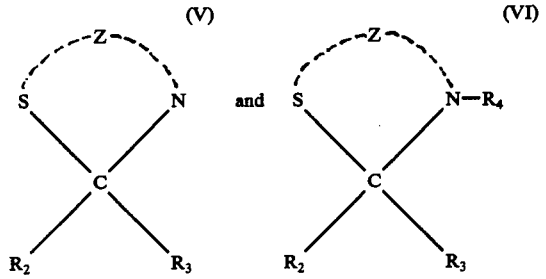

wherein $R_2$, $R_3$, $R_4$ and Z have the same meaning given above. It will be appreciated that the ring system represented by Z may be substituted if desired as in the illustrative compounds of formulae (I) and (IV). When using these compounds in the production of dye images, the color providing moiety is preferably but not necessarily substituted on the carbon atom common to the sulfur and nitrogen atoms where the formation of the color image is based on a difference in diffusibility between the parent color-providing compound and the liberated color-providing moiety and the color-providing moiety selected as the organic radical $R_2$ and/or $R_3$ is a diffusible dye, then $R_4$ and/or a group or groups substituted on the ring Z should be capable of rendering the parent compound substantially immobile in the photographic processing solution. Alternatively, if the color-providing moiety is a non-diffusible dye, the $R_4$ and/or group or groups substituted on Z should be capable of rendering the parent compound diffusible in the processing solution.

Specific examples of color-providing compounds comprising a complete dye, i.e., a dye radical comprising the chromophoric system of a dye and a cyclic moiety, containing the group

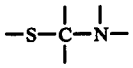

included in the ring are those compounds designated formulas (1) to (36) in col. 18, line 29 through col. 22, line 48 of aforementioned U.S. Pat. No. 3,719,489. These color-providing commpounds form the subject matter of aforementioned U.S. patent application Ser. No. 465,694 and are described in detail on specification pages 37–81 thereof which description, for convenience, is specifically incorporated herein by reference.

In the present invention, the parent color-providing compound may be present in the photosensitive element in the photosensitive layer itself if the compound is inert, that is photographically innocuous in that it does not adversely affect or impair image formation to any appreciable or unacceptable extent. If not photographically innocuous, the compound may be modified in a mamnner which does not interfere with the development process in any way, but which deactivates the compound so that it does not affect adversely the light-sensitive emulsion. Also, the parent color-providing compound may be contained in a layer separate from the silver halide emulsion, for example, in a layer behind the appropriate silver halide emulsion and if desired, may be separated from the emulsion layer by one or more spacer layers.

As noted above, the present invention is concerned with the production of multicolor images by employing a film unit containing at least two selectively sensitized silver halide emulsion layers each having associated therewith a color-providing compound of the type described above which exhibits the desired spectral absorption characteristics. The most commonly employed elements of this type are the so-called tripack structures employing a blue-, a green- and a red-sensitive silver halide emulsion having associated therewith, respectively, a yellow, a magenta and a cyan color-providing material wherein the photosensitive strata and their respective associated color-providing materials are superposed on a single support and processed simultaneously and without separation. In the production of color transfer images, this integral multilayer photosensitive element is processed with a single, common image-receiving layer. For a fuller understanding of the photographic products to which the present invention is directed, reference should be had to the accompanying drawing.

The FIGURE shows one such photographic product during processing thereof to form a color transfer image. As shown in the FIGURE, the photographic product [which has been selectively exposed ] comprises a support 14, carrying a layer 15 containing a cyan color-providing compound; a layer 16 comprising a red-sensitive gelatino silver halide emulsion; a silver scavenger layer 17; a layer 18 containing a magenta color-providing compound; a layer 19 comprising a green-sensitive gelatino silver halide emulsion; a second silver scavenger layer 20; a layer 21 containing a yellow color-providing compound; a layer 22 comprising a blue-sensitive gelatino silver halide emulsion; and a protective overcoat or auxiliary layer 23.

This photosensitive element is shown to be in processing relationship with an image-receiving element comprising a support 25 carrying an image-receiving layer (dyeable stratum) 24. A liquid processing composition 12 is shown to be disposed between the superposed photosensitive and image-receiving elements. In exposed areas of the emulsion layers 16, 19 and 22, silver halide is reduced to image silver while an imagewise distribution of soluble silver complex is formed in terms of unexposed areas. The imagewise distribution of soluble silver complex formed in each of the said emulsion layers is, at least in part, transferred by imbibition to the color-providing compound associated with each emulsion, i.e., the cyan, magenta and yellow color-providing compounds of layers 15, 18 and 21, respectively, where the soluble silver complex accelerates cleavage of the color-providing compound to release a diffusible cyan, magenta and yellow color-providing moiety, for example, a cyan, a magenta and a yellow dye in areas corresponding to the unexposed areas of the respective emulsion layers 16, 19, and 22. The imagewise distributions of diffusible cyan, magenta and yellow dyes produced in this manner transfer, by diffusion, to the dyeable image-receiving layer 24 to form a positive multicolor transfer image. Silver scavenger layers 17 and 20 confine the diffusion of soluble silver complex formed in each of the emulsion layers to the color-providing material associated with each. The soluble silver complex of the red-sensitive emulsion is confined to the cyan color-providing material, the soluble silver complex of the green sensitive emulsion is confined to the magenta color-providing material, and the soluble silver complex of the blue-sensitive emulsion is confined to the yellow color-providing material.

Processing composition 12 may be applied to the photosensitive element by coating, dipping, spraying or any or all of the ingredients thereof may be confined initially in a frangible container such as disclosed in U.S. Pat. No. 2,543,181, the container being positioned in the film unit so as to be capable upon rupture of releasing its contents for spreading in a substantially uniform layer between the superposed layers. It will be appreciated that the respective elements may be placed in superposition prior to, during or following impregnation with the processing composition according to procedures known in the art.

The film structure shown in the FIGURE may be varied, for example, by employing one or more interlayers between those of the emulsion and cleavable color-providing compound as suggested above, by including a yellow filter, e.g., a layer comprising benzidine yellow in front of the green sensitive emulsion or by varying the order of the layers and is intended to be illustrative only of one embodiment structure useful in the preparation of multicolor images according to the present invention.

Rather than liberating a complete dye as described above, the color-providing moiety released may be a dye intermediate which reacts with a reagent such as a methylene coupler to yield a complete dye as described in aforementioned U.S. Pat. No. 3,719,488 which patent, for convenience, is specifically incorporated herein. In this embodiment, a layer containing color-providing compound and coupler may be associated with each of the selectively sensitized emulsion layers in the photosensitive element and an imagewise distribution of a complete dye having the desired spectral absorption characteristics formed upon application of the processing composition. To form a transfer image, the dye produced should be capable of diffusing in the processing composition. By using a transparent receiving element, the resulting transfer image, when stripped from the photosensitive element, may be viewed by transmitted light as a transparency. By including an appropriately positioned light-reflecting layer, e.g., of a white pigment such as titanium dioxide, or means for providing such a layer, the image may be viewed as a reflection print without separating the image-receiving and photosensitive elements. Color transparencies and reflection prints of this type also may be produced in this manner where the diffusible color-providing moiety released is a complete dye.

The following examples are given to illustrate the present invention and are not intended to limit the scope thereof.

EXAMPLE 1

A photosensitive element using as the color-providing compounds to release a cyan dye and a yellow dye cyan

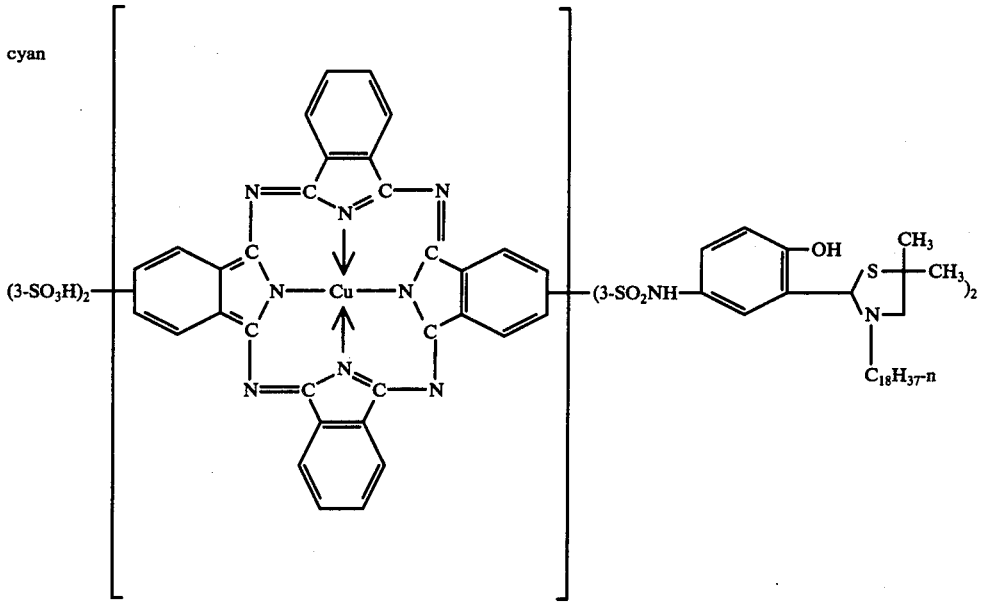

yellow

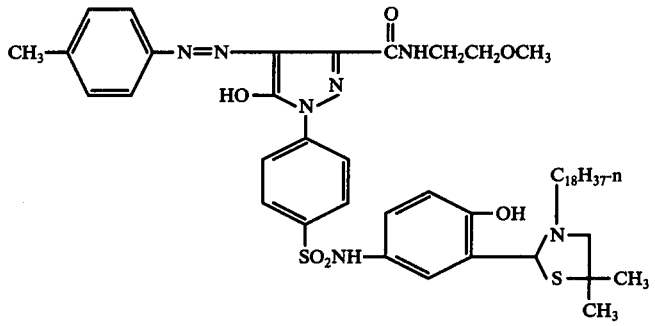

was prepared by coating a transparent polyethylene terephthalate film base with the following layers:

1. a layer of cyan color-providing compound dispersed in gelatin and coated at a coverage of about 60 mgs/ft.$^2$ of cyan color-providing compound and about 60 mgs/ft.$^2$ of gelatin;

2. a red-sensitive gelatino silver iodobromide emulsion coated at a coverage of about 35 mgs/ft.$^2$ of silver and about 60 mgs/ft.$^2$ of gelatin;

3. a layer of the potassium salt of poly [1-(p-vinylphenyl)-1,2,3,4-tetrazole-5-thiol] coated from aqueous solution at a coverage of about 100 mgs/ft.$^2$;

4. a layer of yellow color-providing compound and padding Yellow GL (a benzidine yellow pigment employed as a yellow filter) dispersed in gelatin and coated at a coverage of about 40 mgs/ft.$^2$ of yellow color-providing compound, 50 mgs/ft.$^2$ of Padding Yellow GL and about 90 mgs/ft.$^2$ of gelatin;

5. a blue-sensitive gelatino silver iodobromide emulsion coated at a coverage of about 30 mgs/ft.$^2$ of silver and about 52 mgs/ft.$^2$ of gelatin; and 6. a layer of gelatin coated at a coverage of about 30 mgs/ft.$^2$.

A transparent polyethylene terephthalate film base was coated, in succession, with the following layers to form an image-receiving element:

1. a layer of the partial butyl ester of polyethylene/-maleic anhydride copolymer coated at a coverage of about 2500 mgs/ft.$^2$;

2. a layer containing a mixture (40:1 ratio) of a 60–3-0–4–6 copolymer of butylacrylate, diacetone acrylamide, styrene and methacrylic acid and polyacrylamide at a coverage of about 500 mgs/ft.$^2$; and 3. a polymeric image-receiving layer containing a 2:1 mixture, by weight, of polyvinyl alcohol and poly-4-vinylpyridine, at a coverage of about 300 mgs/ft.$^2$ and containing a silver halide solvent precursor of the formula

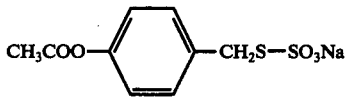

at a coverage of about 50 mgs/ft.$^2$.

The photosensitive element was exposed to red and blue light and processed in superposed relationship with the image-receiving element by spreading an aqueous alkaline processing composition in a layer approximately 0.0024 inch thick between the superposed elements. The processing composition employed comprised:

| | |
|---|---|
| Water | 100.0 cc. |
| Sodium hydroxide | 5.0 g. |
| Sodium carboxymethyl cellulose | 3.4 g. |
| Chlorohydroquinone | 1.3 g. |
| Phenidone | 0.7 g. |
| Sodium sulfite | 2.0 g. |

-continued

| | |
|---|---|
| Titanium dioxide | 50.0 g. |

As a control, a photosensitive element was prepared, exposed and processed as described above except that layer 3 of the photosensitive element was a layer of gelatin coated at a coverage of about 200 mgs/ft.$^2$ and layer 4 contained 40 mgs/ft.$^2$ each of yellow color-providing compound and gelatin with the benzidine yellow (50 mgs/ft.$^2$) being dispersed in a separate layer of gelatin (50 mgs/ft.$^2$) disposed between layers 4 and 5.

After a processing time of about 10 minutes, it was observed that the test integral negative-positive reflection print of Example 1 exhibited better color isolation than that of the control.

EXAMPLE 2

A photosensitive element using as the color-providing compounds to release a magenta and a yellow dye

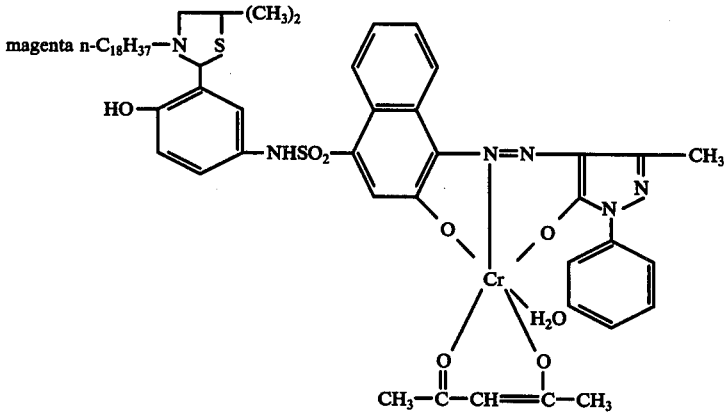

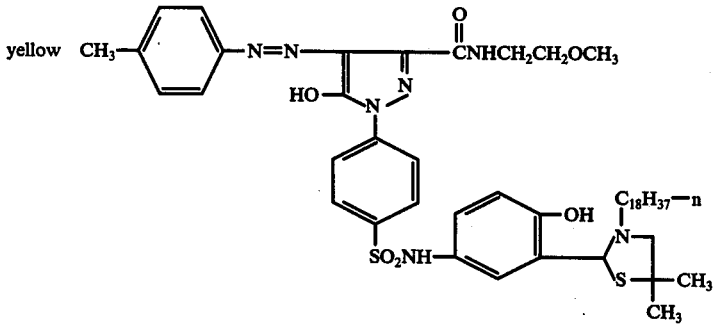

was prepared by coating a transparent polyethylene terephthalate film base with the following layers:

1. a layer of magenta color-providing compound dispersed in gelatin and coated at a coverage of about 50 mgs/ft.$^2$ of magenta color-providing compound and about 50 mgs/ft.$^2$ of gelatin;
2. a green-sensitive gelatino silver iodochloride emulsion coated at a coverage of about 40 mgs/ft.$^2$ of silver and about 36 mgs/ft.$^2$ of gelatin;
3. A layer of gelatin coated at a coverage of 15 mgs/ft.$^2$;
4. a layer of cadmium sulfide dispersed in gelatin and coated at a coverage of 0.34 mg/ft.$^2$ of cadmium sulfide and 5 mgs/ft.$^2$ of gelatin;
5. a layer of yellow color-providing compound and Padding Yellow GL dispersed in gelatin and coated at a coverage of about 50 mgs/ft.$^2$ of yellow color-providing compound about 50 mgs/ft.$^2$ of Padding Yellow and about 50 mgs/ft.$^2$ of gelatin;
6. a blue-sensitive gelatino silver iodochloride emulsion coated at a coverage of about 30 mgs/ft.$^2$ of silver and about 27 mgs/ft.$^2$ of gelatin; and
7. a layer of gelatin coated at a coverage of about 30 mgs/ft.$^2$.

A transparent polyethylene terephthalate film base was coated, in succession, with the following layers to form an image-receiving element.

1. a layer of the partial butyl ester of polyethylene/-maleic anhydride copolymer coated at a coverage of about 2500 mgs/ft.$^2$;
2. a layer containing a mixture (40:1 ratio) of a 60–30–4–6 copolymer of butylacrylate, diacetone acrylamide, styrene and methacrylic acid and polyvinylalcohol at a coverage of about 500 mgs/ft.$^2$; and
3. a polymeric image-receiving layer containing a 2:1 mixture, by weight, of polyvinyl alcohol and poly-4-vinylpyridine, at a coverage of about 300 mgs/ft.$^2$.

The photosensitive element was exposed to green and blue light and processed in superposed relationship with the image-receiving element by spreading an aqueous alkaline processing composition in a layer approximately 0.0032 inch thick between the superposed elements. The processing composition employed comprised:

| | |
|---|---|
| Water | 100.0 cc |
| Sodium hydroxide | 5.0 g. |
| Sodium carboxymethyl cellulose | 3.4 g. |
| Tetramethyl reductic acid | 6.0 g. |
| 4-methylthiomethyl uracil | 1.5 g. |
| Sodium sulfite | 2.0 g. |
| Titanium dioxide | 50.0 g. |

As a control, a photosensitive element was prepared, exposed and processed as described above except that the cadmium sulfide was omitted from layer 4 of the photosensitive element.

After a processing time of about 10 minutes, it was observed that the test integral negative-positive reflection print of Example 2 exhibited better color isolation than the control. After 18 hours, the integral reflection density to blue light where the test bichrome received blue exposure but no green exposure was reduced by 0.61 density units as compared to the control, while the density to green light remained relatively constant being about 0.14 density units less than the control. The reflection density to green light where the test bichrome received green exposure but no blue exposure was reduced by 0.08 density units, while the reflection density to blue light remained substantially the same as the control.

EXAMPLE 3

Example 2 was repeated except that layer 3 of the photosensitive element contained 17.5 mgs/ft.$^2$ of gelatin and layer 4 contained 0.17 mg/ft.$^2$ of cadmium sulfide and 2.5 mgs/ft.$^2$ of gelatin.

Compared to the same control as used in Example 2, it was found after 18 hours that the integral reflection density to blue light where the test bichrome received blue exposure but no green exposure was reduced by 0.47 density units, while the density to green light remained relatively constant being about 0.12 density units less than the control. The reflection density to green light where the bichrome received green exposure but no blue exposure was reduced by 0.05 density units, while the density to blue light remained relatively constant being about 0.13 density units more than the control.

Besides the silver ion scavengers used in the above examples, it was also found that silver proteinate was effective as a silver ion scavenger layer for improving color isolation.

In the foregoing examples, the color-providing compounds were dispersed in gelatin as a particulate dispersion according to the procedure described in U.S. Pat. No. 3,438,775.

The processing compositions employed in the present invention comprise an aqueous alkaline solution of a silver halide solvent and a silver halide developing agent. The named ingredients may be present initially in the aqueous medium or may be present initially elsewhere in the photographic product, for example, in the emulsion and/or image-receiving and/or spacer layers as heretofore suggested in the art. When such ingredients are present initially in a layer or layers of the film unit, the processing composition is formed by contacting the product with a suitable aqueous medium to form a solution containing these ingredients.

The alkali employed in the processing composition may be any of the alkaline material heretofore used, such as sodium or potassium hydroxide. The silver halide solvent also may be any of the heretofore known materials, such as, sodium or potassium thiosulfate, sodium thiocyanate and uracil. Also, a silver halide solvent precursor may be used, such as described in U.S. Pat. No. 3,698,898 issued Oct. 17, 1972 and as used in Example 1 above. The silver halide developing agent may be selected from those commonly employed such as the diamino benzenes, e.g., paraphenylene-diamine; aminophenols, e.g., methyl-p-aminophenol; dihydroxybenzenes, e.g., hydroquinone; and enediols, e.g., ascorbic acid and tetramethyl reductic acid. In addition to the aforementioned ingredients, the composition may contain antifoggants, preservatives, viscosity-imparting reagents, and other adjuncts as conventionally used in the art. It will be understood that the selection of the above materials is not critical to the practice of this invention.

In various embodiments of the present invention, other silver halide emulsions may be used, such as silver chloride, silver bromide, silver bromoiodide, silver chlorobromide and silver chlorobromoiodide. In lieu of the usual negative-working silver halide emulsions, direct positive silver halide emulsions may be employed. By using such an emulsion in Example 1 above, for instance, a negative rather than a positive transfer image may be produced. Typical materials that may be used as the support for the photosensitive and image-receiving elements are paper, glass and plastic materials, e.g., celulose nitrate, cellulose acetate, polyvinyl acetal, polystyrene, polyethyleneterephthalate, polyethylene and polypropylene.

It will be appreciated that the photographic system of the present invention may be used with film structures other than those illustrated. For example, in diffusion transfer film units the negative component and the positive component may be separate elements as shown above which are brought together during processing and thereafter either retained together as the final print or separated following image formation.

Rather than the photosensitive layers and the image-receiving layer being in separate elements, they may be in the same element. In such a film unit, the image-receiving layer is coated on a support and the photosensitive layers are coated on the upper surface of the image-receiving layer. The liquid processing composition is applied between the combined negative-positive element and a spreading sheet which assists in spreading the liquid composition in a uniform layer adjacent the surface of the photosensitive layer.

Illustrative of still other film units are those where the negative and positive components together may comprise a unitary structure, e.g., integral negative-positive film units wherein the negative and positive components are laminated and/or otherwise physically retained together at least prior to image formation. Generally, such film units comprise a plurality of essential layers including a negative component comprising a image-receiving layer which components may be laminated together or otherwise secured together in physical juxtaposition as a single structure. In the formation of color transfer images, the dye image-providing compounds of the present invention may be associated with the silver halide layers of the negative component.

Included among such structures are those adapted for forming a transfer image viewable without separation, i.e., wherein the positive component containing the transfer image need not be separated from the negative component for viewing purposes. In addition to the aforementioned essential layers, such film units include means for providing a reflecting layer between the image-receiving and negative components in order to mask effectively the silver images formed as a function of development of the silver halide layers and any remaining associated dye image-providing material and also to provide a background for viewing the transfer image in the receiving component, without separation, by reflected light. This reflecting layer may comprise a preformed layer of a reflecting agent included in the essential layers of the film unit or the reflecting agent may be provided subsequent to photoexposure, e.g., by including the light-reflecting agent in the processing composition. In addition to the aforementioned layers, such film units usually include dimensionally stable outer support layers, the transfer dye image being viewable through one of said supports.

These film units optionally may contain other layers capable of performing specific desired functions. For example, where it is desirable to adjust the alkalinity of the environment in the image-receiving layer following substantial transfer of the dye image-providing material, the pH reduction may be effected by including, preferably in the image-receiving component of the film unit, a neutralizing layer comprising an acid-reacting reagent such as a polymeric acid layer as described in U.S. Pat. No. 3,362,819. An inert interlayer or spacer layer may be and is preferably disposed between the polymeric acid layer and the image-receiving layer in order to control or "time" the pH reduction. Suitable spacer or "timing" layers for this purpose are described with particularity in U.S. Pat. Nos. 3,362,819; 3,419,389; 3,421,893; 3,455,686; and 3,575,701. The image-receiving layer may comprises any of the materials known in the art, such as polyvinyl alcohol, gelatin, etc. and may contain agents adapted to mordant or otherwise fix the transferred image dyes. Particularly useful materials comprise polyvinyl alcohol or gelatin containing a dye mordant such as poly-4-vinylpyridine, as disclosed in U.S. Pat. No. 3,148,061. Also, such film units usually are employed in conjunction with means, such as, a rupturable container containing the requisite processing composition and adapted upon application of pressure of applying its contents to develop the exposed film unit.

It will be appreciated that the expression "color" as used throughout the foregoing specification and in the appended claims is intended to include the use of a plurality of colors to obtain black.

Since certain changes may be made in the above products and processes without departing from the scope of the invention herein involved, it is intended that all matter contained in the above description shall be interpreted as illustrative and not in a limiting sense.

What is claimed is:

1. A photographic product which comprises a photosensitive element comprising a plurality of layers including a support, at least two selectively sensitized silver halide emulsion layers, each of said emulsion layers having associated therewith a color-providing compound capable of undergoing cleavage in the presence of an imagewise distribution of silver ions and/or soluble silver complex to liberate a color-providing moiety in an imagewise distribution corresponding to said distribution of silver ions and/or said complex, one of said color-providing compound and said color-providing moiety being diffusible in aqueous alkaline solution and the other being substantially non-diffusible in aqueous alkaline solution, and a scavenger layer containing a scavenger for silver ion and/or soluble silver complex, said scavenger layer being positioned between said two selectively sensitized silver halide emulsion layers, each of said color-providing compounds being a compound containing a group selected from $-S-X-\overset{|}{N}-$ and $-S-X-N=$ wherein X is -continued

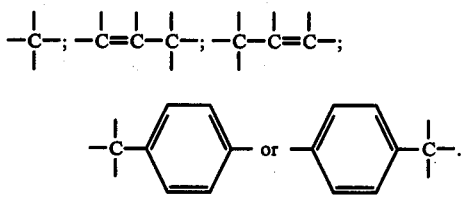

2. A product as defined in claim 1 wherein said selectively sensitized emulsion layers are a red-sensitive emulsion, a green-sensitive emulsion, and a blue-sensitive emulsion, and said color-providing compounds associated with said silver halide emulsions are, respectively, a cyan color-providing compound, a magenta color-providing compound and a yellow color-providing compound.

3. A product as defined in claim 2 which includes a first scavenger layer positioned between said red-sensitive and said green-sensitive silver halide emulsions and a second scavenger layer positioned between said green-sensitive and said blue-sensitive silver halide emulsions.

4. A product as defined in claim 1 wherein said scavenger layer comprises a silver complexing agent capable of forming a non-diffusible silver complex.

5. A product as defined in claim 1 wherein said scavenger layer comprises a silver complexing agent capable of forming a silver complex decomposable to a silver precipitating agent.

6. A product as defined in claim 1 wherein said scavenger layer comprises a silver precipitating agent.

7. A product as defined in claim 6 wherein said scavenger layer comprises a silver precipitating agent dispersed in a layer of gelatin.

8. A product as defined in claim 4 wherein said silver complexing agent is a polymer containing mercapto groups.

9. A product as defined in claim 1 wherein each said color-providing compound contains the groups $$-S-X-\overset{|}{N}-.$$

10. A product as defined in claim 10 wherein X is $$-\overset{|}{\underset{|}{C}}-.$$

11. A product as defined in claim 10 wherein each said compound is a cyclic compound having a ring system containing up to 20 members and said $$-S-X-\overset{|}{N}-$$

group is included in the ring.

12. A product as defined in claim 11 wherein each said color-providing compound is a thiazolidine.

13. A product as defined in claim 1 wherein each said color-providing compound is substantially non-diffusible and said color-providing moiety released therefrom is diffusible in aqueous alkaline solution.

14. A product as defined in claim 13 wherein each said color-providing moiety liberated from each said color-providing compound is a diffusible dye.

15. A product as defined in claim 14 including a superposed image-receiving layer so positioned as to be capable of receiving by diffusion transfer an imagewise distribution of each said diffusible dye and further including means for applying an aqueous alkaline processing composition in a substantially uniform layer between said silver halide emulsions and said image-receiving layer.

16. A product as defined in claim 15 wherein said image-receiving layer is carried on a transparent support and said product additionally includes means for providing a light-reflecting layer between said image-receiving layer and said silver halide emulsions to mask said silver halide emulsions after development thereof and to provide a white background for viewing a dye image in said image-receiving layer.

17. A product as defined in claim 16 wherein said silver halide emulsions are adapted to be exposed through said transparent support.

18. A product as defined in claim 17 wherein said means for providing an aqueous alkaline processing composition comprises a rupturable container releasably retaining an aqueous alkaline solution of a silver halide developing agent positioned between said image-receiving layer and said silver halide emulsions.

19. A product as defined in claim 18 wherein said means for providing a light-reflecting layer comprise a white pigment dispersed in said processing composition.

20. A photographic process for forming multicolor images comprising the steps of a. exposing a photosensitive element comprising a plurality of layers including a support, at least two selectively sensitized silver halide emulsion layers, each of said emulsion layers having associated therewith, a color-providing compound capable of undergoing cleavage in the presence of an imagewise distribution of silver ions and/or soluble silver complex to liberate a color-providing moiety in an imagewise distribution corresponding to said distribution of silver ions and/or said complex, one of said color-providing compound and said color-providing moiety being diffusible in aqueous alkaline solution and the other being substantially non-diffusible in aqueous alkaline solution, and a scavenger layer containing a scavenger for silver ion and/or soluble silver complex, said scavenger layer being positioned between said two selectively sensitized silver halide emulsion layers, each of said color-providing compounds being a compound containing a group selected from

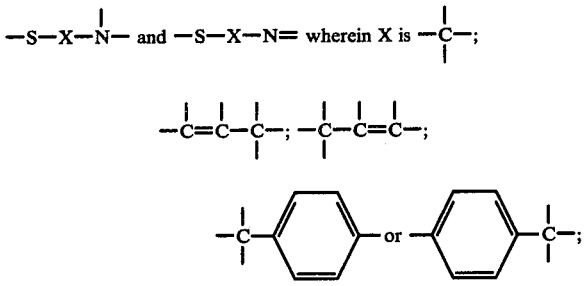

b. applying an aqueous alkaline processing composition to said photosensitive element to provide an aqueous alkaline solution of a silver halide developing agent and a silver halide solvent therein, thereby developing said photosensitive element;

c. forming in undeveloped areas of each of said emulsions an imagewise distribution of silver ions and/or soluble silver complex; and d. contacting said imagewise distribution of silver ions and/or soluble silver complex formed in each of said emulsion with the emulsion's associated color-providing compound thereby forming corresponding imagewise distributions of each of said color-providing moieties.

21. A process as defined in claim 20 wherein said selectively sensitized emulsion layers are a red-sensitive emulsion, a green-sensitive emulsion, and a blue-sensitive emulsion, and said color-providing compounds associated with said silver halide emulsions are, respectively, a cyan color-providing compound, a magenta color-providing compound and a yellow color-providing compound.

22. A process as defined in claim 21 which includes a first scavenger layer positioned between said red-sensitive and said green-sensitive silver halide emulsions and a second scavenger layer positioned between said green-sensitive and said blue-sensitive silver halide emulsions.

23. A process as defined in claim 20 wherein said scavenger layer comprises a silver complexing agent capable of forming a non-diffusible silver complex.

24. A process as defined in claim 20 wherein said scavenger layer comprises a silver complexing agent capable of forming a silver complex decomposable to a silver precipitating agent.

25. A process as defined in claim 20 wherein said scavenger layer comprises a silver precipitating agent.

26. A process as defined in claim 25 wherein said scavenger layer comprises a silver precipitating agent dispersed in a layer of gelatin.

27. A process as defined in claim 26 wherein said precipitating agent is cadmium sulfide.

28. A process as defined in claim 23 wherein said silver complexing agent is a polymer containing mercapto groups.

29. A process as defined in claim 20 wherein each said color-providing compound contains the groups

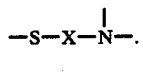

30. A process as defined in claim 29 wherein X is

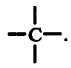

31. A process as defined in claim 30 wherein each said compound is a cyclic compound having a ring system containing up to 20 members and said

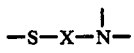

group is included in the ring.

32. A process as defined in claim 31 wherein each said color-providing compound is a thiazolidine.

33. A process as defined in claim 20 wherein each said color-providing compound is substantially non-diffusible and each said color-providing moiety released therefrom is diffusible in aqueous alkaline solution.

34. A process as defined in claim 33 wherein each said color-providing moiety liberated from each said color-providing compound is a diffusible dye.

35. A process as defined in claim 34 wherein a sheet-like element comprising an image-receiving layer is superposed with said photosensitive element and at least a portion of said imagewise distributions of each of said diffusible dyes is transferred to said image-receiving layer to form a color transfer image thereon.

36. A process as defined in claim 35 wherein said aqueous alkaline processing composition is distributed in a substantially uniform layer between said image-receiving layer and said silver halide emulsions.

37. A process as defined in claim 36 wherein said image-receiving layer is carried on a transparent support.

38. A process as defined in claim 37 which includes providing a light-reflecting layer between said image-receiving layer and said silver halide emulsions to mask said silver halide emulsions after development thereof and to provide a white background for viewing the dye image in said image-receiving layer.

39. A process as defined in claim 38 wherein said light-reflecting layer is provided by including a white pigment dispersed in said processing composition.

40. A process as defined in claim 39 which includes the step of maintaining said photosensitive element and said sheet-like element intact subsequent to processing.

41. A process as defined in claim 35 wherein said selectively sensitized emulsion layers are a red-sensitive emulsion, a green-sensitive emulsion, and a blue-sensitive emulsion, and said color-providing compounds associated with said silver halide emulsions are, respectively, a cyan color-providing compound, a magenta color-providing compound and a yellow color-providing compound.

42. A process as defined in claim 41 which includes a first scavenger layer positioned between said red-sensitive and said green-sensitive silver halide emulsions and a second scavenger layer positioned between said green-sensitive and said blue-sensitive silver halide emulsions.

43. A process as defined in claim 35 wherein said scavenger layer comprises a silver complexing agent capable of forming a non-diffusible silver complex.

44. A process as defined in claim 35 wherein said scavenger layer comprises a silver complexing agent capable of forming a silver complex decomposable to a silver precipitating agent.

45. A process as defined in claim 35 wherein said scavenger layer comprises a silver precipitating agent.

46. A process as defined in claim 45 wherein said scavenger layer comprises a silver precipitating agent dispersed in a layer of gelatin.

47. A process as defined in claim 46 wherein said silver precipitating agent is cadmium sulfide.

48. A process as defined in claim 43 wherein said silver complexing agent is a polymer containing mercapto groups.

49. A process as defined in claim 41 wherein each said color-providing compound contains the group $$-S-X-\overset{|}{N}-.$$

50. A process as defined in claim 49 wherein X is $$-\overset{|}{\underset{|}{C}}-.$$

51. A process as defined in claim 50 wherein each said compound is a cyclic compound having a ring system containing up to 20 members and said $$-S-X-\overset{|}{N}-$$

group is included in the ring.

52. A process as defined in claim 51 wherein each said color-providing compound is thiazolidine.

* * * * *